US008820689B2

(12) United States Patent
Reidt et al.

(10) Patent No.: US 8,820,689 B2
(45) Date of Patent: Sep. 2, 2014

(54) GUIDE RAIL HAVING A QUICK FASTENING DEVICE

(75) Inventors: Daniel Reidt, Herford (DE); Sven Budde, Lubbecke (DE); Holger Redeker, Lohne (DE); Timo Kaps, Werther (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 292 days.

(21) Appl. No.: 13/391,721

(22) PCT Filed: Aug. 12, 2010

(86) PCT No.: PCT/EP2010/061757

§ 371 (c)(1), (2), (4) Date: Feb. 22, 2012

(87) PCT Pub. No.: WO2011/023561

PCT Pub. Date: Mar. 3, 2011

(65) Prior Publication Data

US 2012/0145856 A1 Jun. 14, 2012

(30) Foreign Application Priority Data

Aug. 25, 2009 (DE) ..... 20 2009 005 177 U

(51) Int. Cl.

| | |
|---|---|
| ***A47B 96/00*** | (2006.01) |
| ***A47B 88/04*** | (2006.01) |
| ***F24C 15/16*** | (2006.01) |

(52) U.S. Cl.

CPC ..... *F24C 15/168* (2013.01); *A47B 88/044* (2013.01)

USPC ..... 248/226.11; 248/220.21; 24/563; 403/397

(58) Field of Classification Search

CPC ..... A47B 88/044; F24C 15/16; F24C 15/168; A47L 15/504; A47L 15/507

USPC ..... 248/226.11, 220.21; 24/563; 403/326, 403/397; 126/339; 211/126.15, 133.5, 162; 312/402, 410, 228.1

See application file for complete search history.

(56) References Cited

U.S. PATENT DOCUMENTS

| | | | | |
|---|---|---|---|---|
| 3,806,994 | A * | 4/1974 | Lankford | 403/397 |
| 6,643,900 | B2 * | 11/2003 | Jahrling | 24/563 |
| 8,162,560 | B2 * | 4/2012 | Wittgrebe | 403/397 |

(Continued)

FOREIGN PATENT DOCUMENTS

| | | |
|---|---|---|
| DE | 30 30 199 | 3/1982 |
| DE | 20 2004 005 475 | 8/2004 |
| DE | 20 2006 002 251 | 7/2007 |

*Primary Examiner* — Anita M King

(74) *Attorney, Agent, or Firm* — Barnes & Thornburg LLP

(57) ABSTRACT

A guide rail configured to be mounted on bars of a grid side part of a household appliance or furniture. The bars run horizontally and are bent at an angle in bent end regions. The guide rail includes a quick fastening device including two mounting elements attached in end regions of the guide rail and configured to be detachably fixed to the bars of the grid side part. A first mounting section partially encloses one of the bars in a longitudinally extending region of the bar. A second mounting section partially encloses the bar at one of the bent regions of the bar. One of the mounting sections faces a rear bent end region and is open in a direction towards a rear of the guide rail. A resilient catch lug extends upward from the leg and engages behind the bar that is enclosed by the mounting elements.

12 Claims, 6 Drawing Sheets

(56) References Cited

U.S. PATENT DOCUMENTS

| | | | | |
|---|---|---|---|---|
| 8,573,720 | B2 * | 11/2013 | Wittgrebe | 312/410 |
| 2005/0217501 | A1 * | 10/2005 | Babucke et al. | 99/450 |
| 2009/0016812 | A1 * | 1/2009 | Wittgrebe | 403/189 |
| 2009/0127217 | A1 * | 5/2009 | Wittgrebe | 211/162 |
| 2011/0113597 | A1 * | 5/2011 | Budde | 24/457 |
| 2011/0123260 | A1 * | 5/2011 | Budde | 403/188 |
| 2012/0061534 | A1 * | 3/2012 | Rehage | 248/214 |

* cited by examiner

GUIDE RAIL HAVING A QUICK FASTENING DEVICE

This application is a national stage of International Application PCT/EP2010/061757, filed Aug. 12, 2010, and claims benefit of and priority to German Patent Application No. 20 2009 005 177.3, filed Aug. 25, 2009, the content of which Applications are incorporated by reference herein.

BACKGROUND AND SUMMARY

The present disclosure relates to a guide rail that can be mounted on bars of a grid-like side part of a baking oven, a dishwasher, or similar items of furniture. The bars run horizontally and are bent at an angle in bent end regions. The guide rail includes a quick fastening device that includes two mounting elements attached in the end regions of the guide rail and that can be detachably fixed on the bars of the grid-like side part. A first mounting section partially encloses the bar in a longitudinally extending region and a second mounting section partially encloses the bar at the bent end regions. The mounting section of the rear mounting element that is assigned to the rear, bent end region is open in the direction towards the back side of the guide rail. That is so that the guide rail, with the quick fastening device, can be slid onto and attached to one of the bars starting from the front side of the side grid. The front mounting element comprises a leg located below the bar in a section of the mounting element. The mounting section partially encloses the bar in its longitudinally extending region. A flexible catch lug extends upward from the leg, and the lug engages behind the bar enclosed by the mounting element in the assembled position of the guide rail.

A guide rail having a quick fastening device of a generic type is known from DE 20 2006 002 251 U1.

With the construction described therein, the upper, free end of the flexible catch lug extends to approximately a horizontal center plane, or slightly above, of the bar that is gripped by the mounting element.

In order to release the guide rail, if necessary, from its designated mounting position on the bar, it is possible to pivot the catch lug in a manual operation downward to a level beneath the bar, thus enabling the mounting element to be removed sideways from the bar without hindrance.

Under extremely unfavorable external circumstances and with the expenditure of large forces, as well as considering the possibility of deformation, it is at least conceivable, with the state-of-the-art technology, that the guide rail could be unintentionally released from the bar in question.

The embodiments of the present disclosure, improve on and provide for a guide rail so as to guarantee, under all circumstances, a secure fixing to a bar, and in particular, in the front, end region of the bar. According to an embodiment of the present disclosure, this is achieved, for example, in that the upper, free end of a catch lug protrudes into an aperture of the leg of the mounting element overlapping the upper side of the bar.

Through this structurally simple and inexpensive measure, a separation of the mounting element and, therefore, of the guide rail from the bar is only then possible when, by a manual operation, the catch lug is deliberately pulled so far downwards as to enable the mounting element to be pulled sideways over and away from the bar. An accidental release is completely excluded because the upper, free end of the catch lug is fixed in its detent position within the aperture of the upper leg of the mounting element.

This, therefore, guarantees a perfect safeguard against inadvertent releasing.

It is advantageous when the side edge of the catch lug facing the bar and tilted in the direction of the bar extends upwards.

This ensures that, in the case of interaction of lateral forces acting on the mounting element in the release direction, the catch lug is pivoted upwards and is therefore even more securely fixed in the aperture of the upper leg.

Thus, even under extremely high stresses and strains, or when slight deformations of the whole system occur over the course of time, an unintended release of the guide rail cannot occur.

Other features of the embodiments of the present disclosure are discussed herein.

Other aspects of the present disclosure will become apparent from the following descriptions when considered in conjunction with the accompanying drawings.

DETAILED DESCRIPTION

Figure 1:
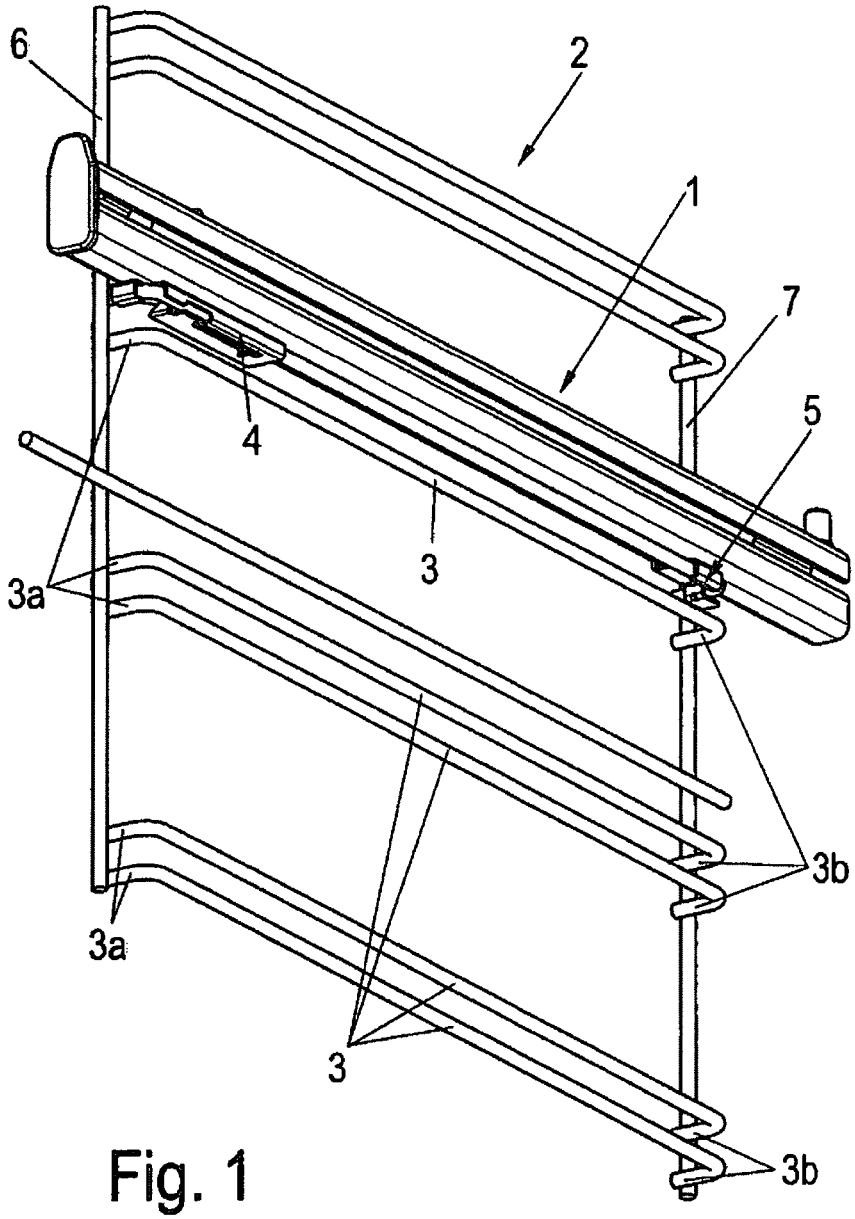
FIG. 1 shows a perspective view of a grid-like side part, or side grid, with a guide rail fixed thereto, according to the present disclosure.

In the drawings, the reference sign 1 refers to a guide rail and the reference sign 2 refers a grid side part, or grid-like side part. The side part 2 includes several horizontally extending bars 3 that are each provided with bent end regions 3*a* and 3*b*. The bent end regions 3*a* are, for example, at each front end, and the end regions 3*b* are, for example, at each rear end of the bars 3.

The underside of the guide rail 1 is provided with a quick fastening device. The quick fastening device includes two mounting elements 4 and 5 that are fixed in the bent end regions 3*a*, 3*b* of the guide rail 1. The mounting element 4 is located at the front end of the guide rail 1 and the mounting element 5 is located at the rear end.

Figure 6:
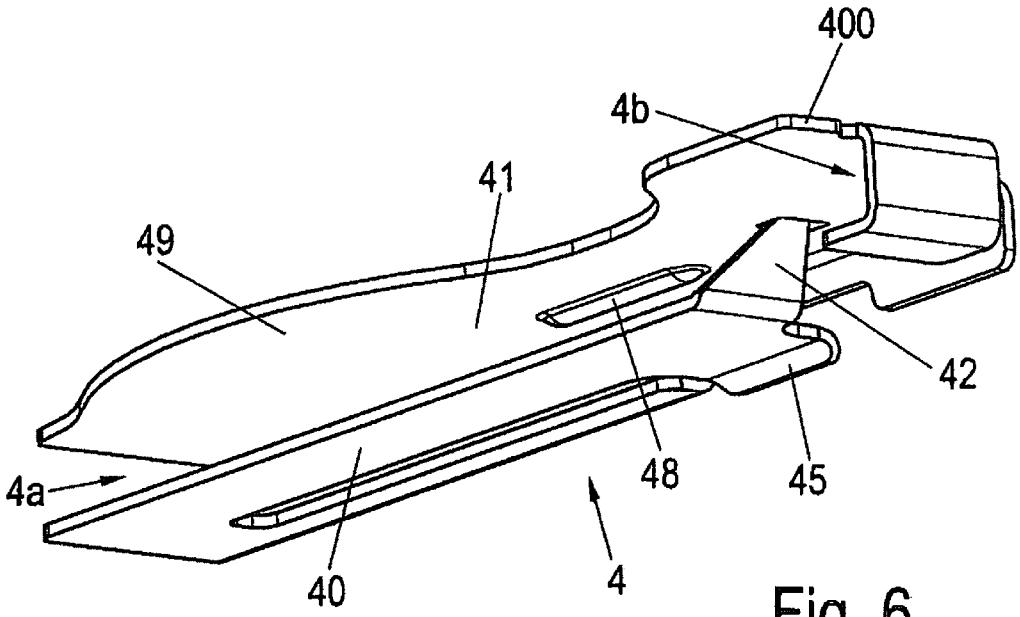
FIG. 6 shows a perspective bottom view of a front mounting element of a guide rail, according to the present disclosure.
Figure 7:
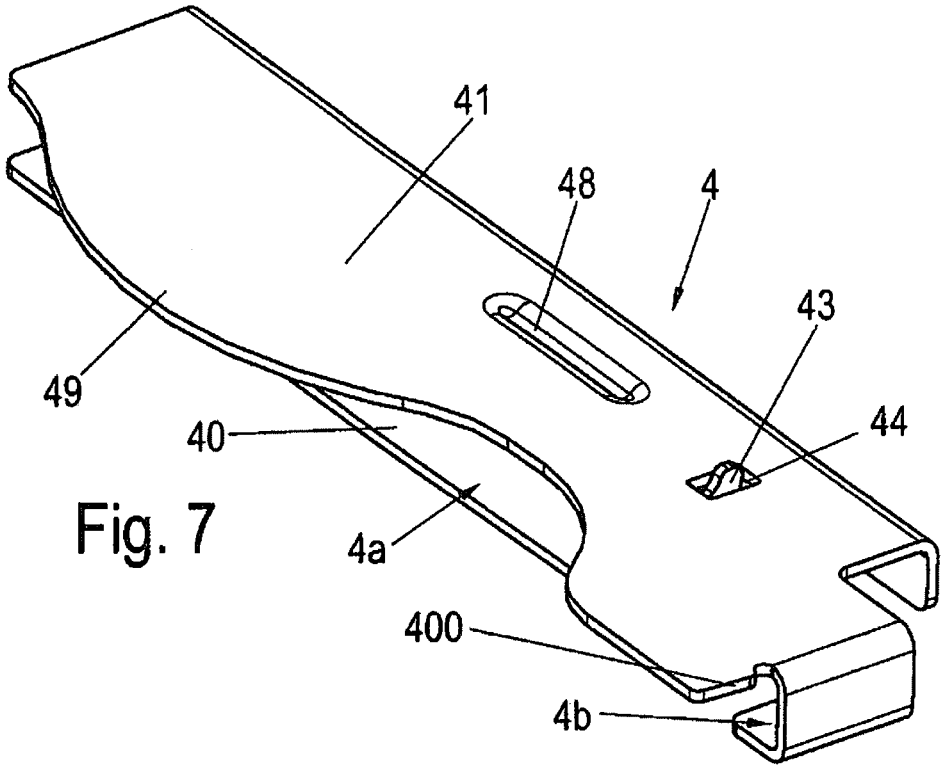
FIG. 7 shows a perspective top view of the front mounting element of FIG. 6.

The front mounting element 4, as shown in FIGS. 6 and 7, is provided with two bracket-like mounting sections 4*a* and 4*b*. These mounting sections 4*a* and 4*b* are at an angle to each other, which corresponds to the number of degrees of the angle of the front, end region 3*a* relative to horizontal bar 3. To this extent, the bracket-like mounting sections 4*a* and 4*b* can, for example, be perpendicular to each other. However, it is within the scope of the present disclosure for the mounting sections 4*a* and 4*b* to be arranged at an angle of more than 90° to each other. In the assembled state, the mounting section 4*a* grips bar 3 in its longitudinally extending region and the mounting section 4*b* grips the bent, front end 3*a* of a bar 3, so that the mounting element 4 can, for example, be fastened in a tilt-proof manner relative to only one bar 3. The fixing of the guide rail 1 in the pull-out direction takes place at a front vertical bar 6 of the grid-like side part 2 by a stop 400 that engages behind the vertical bar 6. The stop 400 is arranged adjacent to the mounting section 4*b* at an upper leg 41. Due to the adjacent arrangement of the stop 400 and the mounting section 4*b*, the fixing of the guide rail 1 takes place in the pull-out direction and also in a direction contrary to the pull-out direction without having to take into account, in this regard, the spacing tolerances to a rear vertical bar 7.

The mounting section 4*a* is limited on its underside by a lower leg 40 and an upper leg 41. A distance between these two legs 40 and 41 relative to each other corresponds, for example, to a diameter of bar 3.

Figure 9:
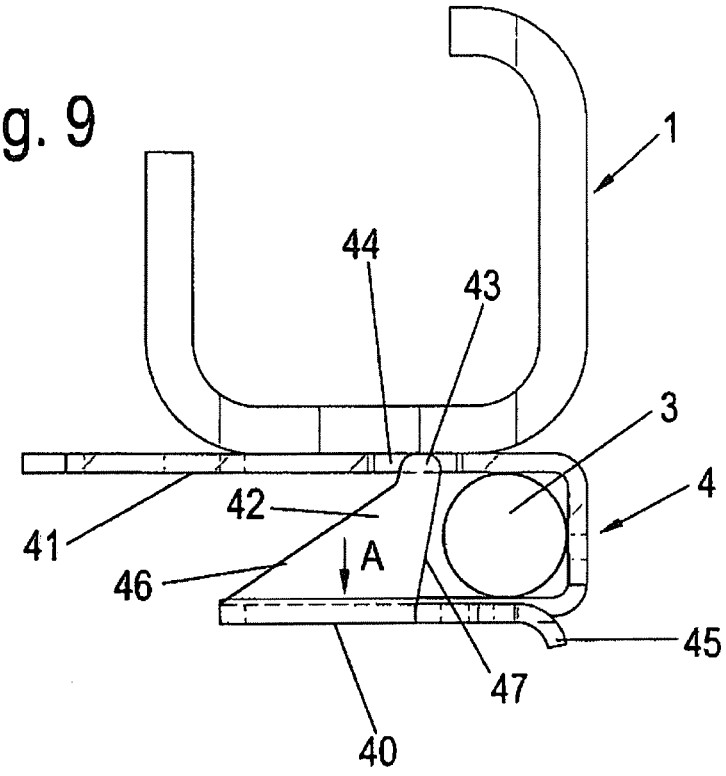
FIG. 9 shows a view through a fastening area of the front, end region of the guide rail, according to the present disclosure.

At the lower leg 40, which engages bar 3 from below in an assembled state, there is a resilient catch lug 42 that extends in an upward direction towards the upper leg 41 and protrudes with its upper, free end 43 into an aperture 44 of the upper leg 41, as shown in FIGS. 7 and 9. FIG. 9 represents a situation when the guide rail 1 is mounted to the bar 3, for example, mounting element 4 is slid onto the bar 3 until it reaches its intended position of use. FIG. 9 illustrates how the resilient catch lug 42 engages behind the bar 3, so that it is only then possible to release the mounting element 4 from the bar 3 when, to begin with, the catch lug 42 is pressed down manually in the direction of the arrow A, as shown in FIG. 9, which is possible without further ado by pressing an operating section 45. If the force that is directed downwards and onto the operation section 45 is removed again, the resilient catch lug 42 moves back into its position in accordance with that shown in FIGS. 6, 7 and 9.

When the mounting element 4 is slid onto bar 3, the catch lug 42, via a lead-in chamfer 46, is automatically pushed under and across the bar 3 until the catch lug 42 can again move freely upwards due to the resilient restoring forces.

In the assembled state as shown in FIG. 9, it is shown that the side edge 47 of the catch lug 42 facing the bar 3 extends upwards and is inclined towards the bar 3.

It has already been mentioned that the free end 43 of the catch lug 42 protrudes into an aperture 44 of the upper leg 41. FIG. 9 shows again that the upper, front side free end 43 of the catch lug 42 is formed in a rounded fashion and with this rounded portion it lies against the underside of the guide rail 1 when corresponding high restoring forces are provided. The catch lug 42 is then pushed up if the mounting element 4 is inadvertently moved in a horizontal direction away from the bar 3, because then the upwardly extending and inclined towards the bar 3 side edge 47 of the catch lug 42 lies against the bar 3 and the corresponding horizontal forces effect a raising of the catch lug 42. A deflection of the catch lug 42 in a horizontal direction is additionally prevented by the safeguard of the end 43 form-fitting in the aperture 44. In addition, in order to assist the form-fitting safeguard, the side of the end 43 facing away from the bar 3 can, for example, be steeper or even vertical (see, for example, FIG. 9).

An inadvertent release is, according to the present disclosure, therefore, safely prevented also when high forces are applied.

As shown in FIGS. 6 and 7, the upper leg 41 has a bead 48 embossed downwards towards the bar 3. The embossing of this bead 48 and its position are thus selected so that sliding the mounting element 4 onto the bar 3 requires a certain amount of force in order to slide the bead 48 over and away from the bar 3 during a simultaneous slight lowering of the upper leg 41 until the bead 48 engages in a position behind the bar 3. This bead 48 indicates to the user during a potential assembly, that the mounting element 4 has assumed its designated position. That is because the user is sensitive to the different exertion forces involved. In addition, and aided by the springing back of the lower leg 40 into a relaxed position, the "jumping over" of the bead 48 over the bar 3 emits a sound that the user hears and can consider it to be a further indication of proper assembly.

In order to facilitate the placement of the mounting element 4, for the purpose of sliding it sideways onto a bar 3, the upper leg 41 is provided with a bulge 49 extending in the direction of the bar 3. The bulge 49 gives the user an easy orientation for the correct placement of the mounting element 4 in respect to the bar 3 to be engaged.

Figure 10:
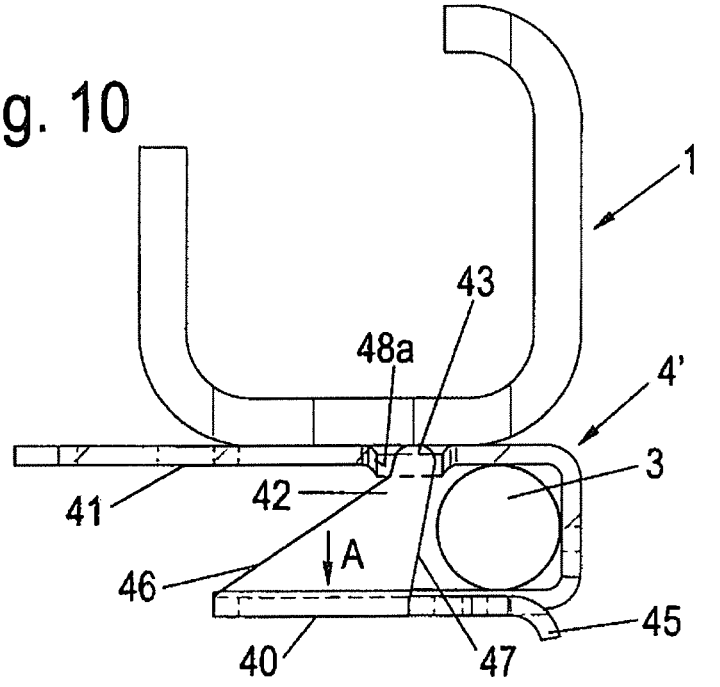
FIG. 10 shows a view, corresponding to the type of view in FIG. 9 according to a another embodiment of a guide rail, and according to the present disclosure.

The orientation guidance for the location and for mounting position of mounting element 4 relative to bar 3, as described above in association with the bead 48, for placing the mounting element 4 onto a bar 3, can within the scope of the present disclosure, be implemented by a mounting element 4', according to an embodiment of the present disclosure, as depicted in FIG. 10. The bead 48 is replaced by an open embossed feature 48*a* directed downwards and into whose opening area the upper, front end 43 of the catch lug 42 can, for example, engage and whose outer margin area, like the bead 48, must be pushed over and away from bar 4 in order to be able to bring the mounting element 4' into its designated mounting position. Also, a movement over the embossed feature 48*a* results in the user receiving the previously noted orientation guidance for the proper location and/or mounting position of the mounting element 4 relative to the bar 3. Furthermore, with a low material thickness of the leg 41, the form-fitted safeguard of the end 43 in the embossed feature 48*a* is improved.

Figure 3:
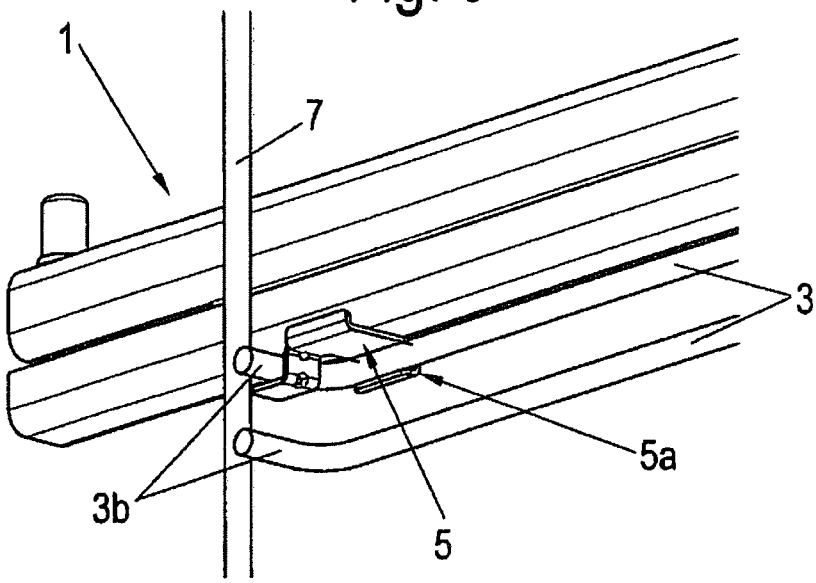
FIG. 3 shows a perspective partial view of a rear, end region of the guide rail attached to the side grid, according to the present disclosure.
Figure 4:
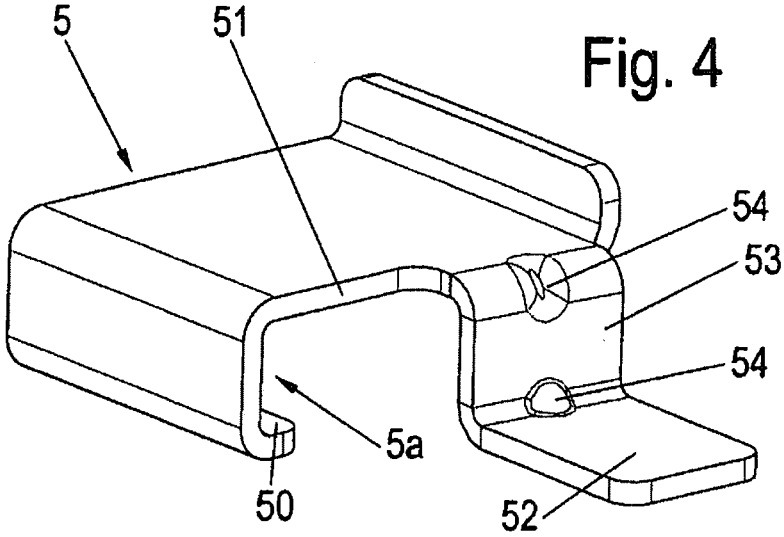
FIG. 4 shows a perspective view of a rear, mounting element of the guide rail, according to the present disclosure.
Figure 5:
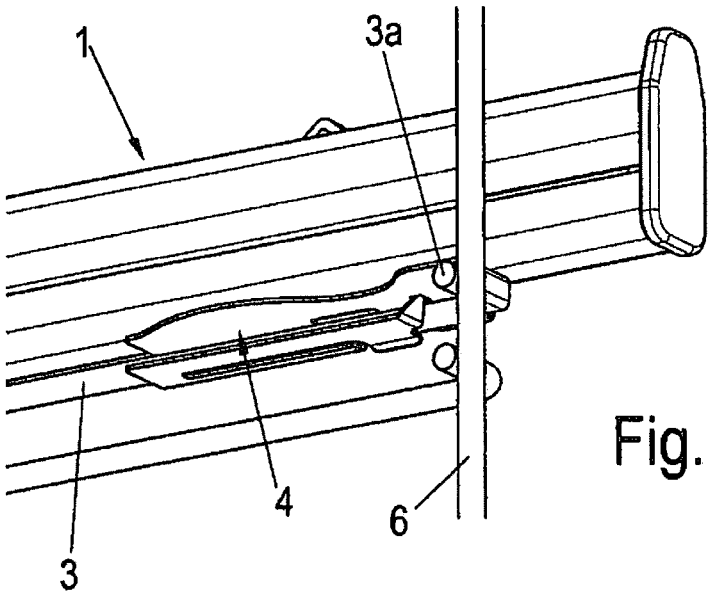
FIG. 5 shows a perspective partial view of the guide rail attached in its front, end region to a side grid, according to the present disclosure.

The rear mounting element 5, as can be seen in FIGS. 3 and 4, is provided with a bracket-like mounting section 5*a* that, in the assembled state, engages around bar 3 in its longitudinally extending area. This bracket-like mounting section 5*a* is limited by a lower leg 50 and an upper leg 51, wherein the distance of these two legs 50 and 51 between each other corresponds, in turn, to the thickness of the bar 3.

In addition, at the rear end region of the guide rail 1, the mounting element 5 is equipped with a support lug 52 that, in the assembled state as depicted in FIG. 3, engages beneath the rear, bent end region 3*b* of bar 3. This support lug 52 is bent or angled downwards from the area of the upper leg 51 of the mounting element 5 and is located on the same plane as the lower leg 50 of the bracket-like mounting section 5*a*. As the support lug 52 only engages beneath the end region 3*b*, the distance tolerances between the vertical bars 6 and 7 are balanced out.

In angled areas of the upper leg 51, an adjoining downwardly directed web 53, and the support lug 52 adjoined thereto, beads 54 are embossed that lead to a stiffening of the mounting element 5 in those angled areas.

Figure 2:
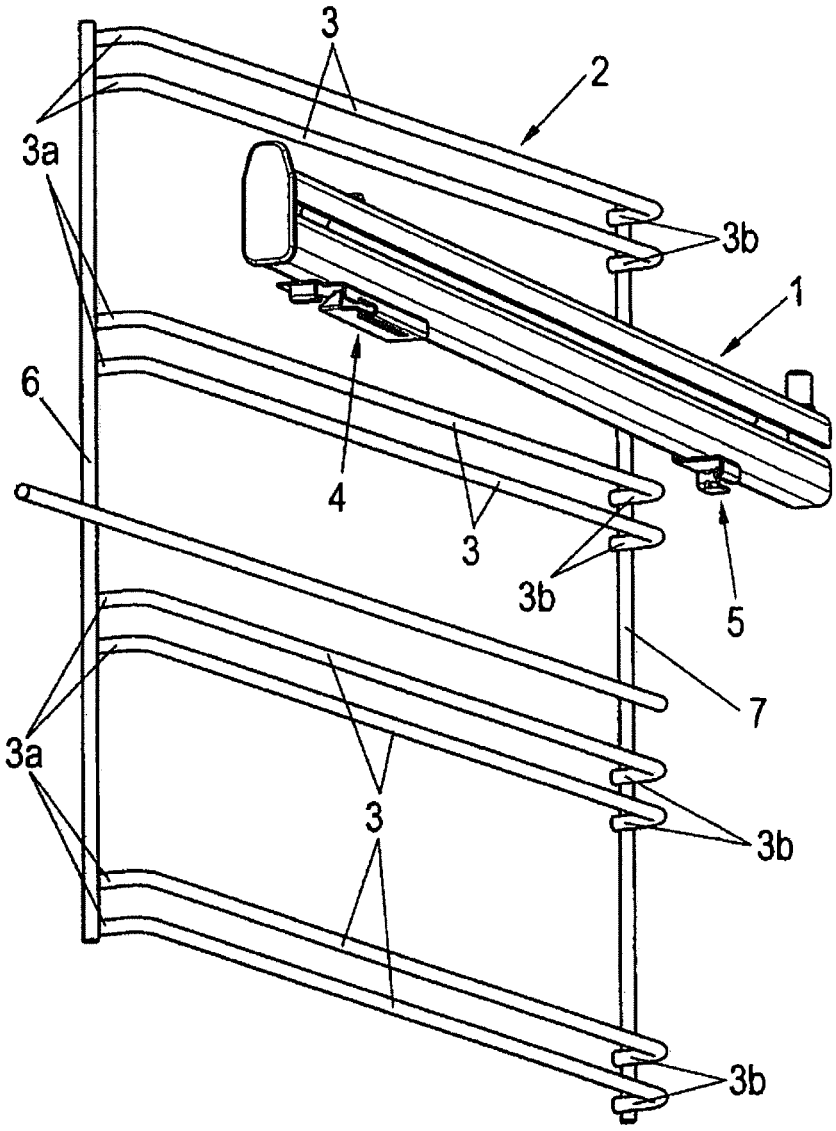
FIG. 2 shows a perspective view, according to FIG. 1, wherein the guide rail is removed from the side grid.
Figure 8:
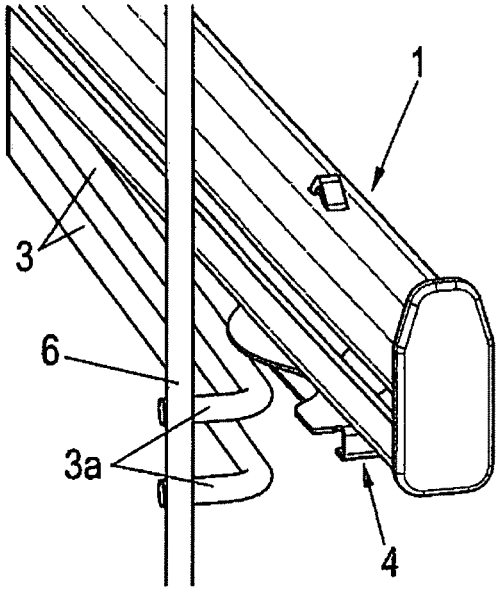
FIG. 8 shows a perspective view of FIG. 5, wherein the guide rail is not finally attached.

The installation of guide rail 1, with the mounting elements 4 and 5 comprising the quick fastening device, to bar 3 of side grid 2 and starting from a position according to FIG. 2, is carried out as follows. To start with, the rear mounting element 5 is set sideways at bar 3 and then, for the moment, is pushed so far to the rear until the web 53 of the rear mounting element 5 strikes the rear, bent end 3*b* of bar 3. After that, the guide rail 1 with the front mounting element 4 is pivoted in a horizontal movement onto bar 3 from a starting position, as follows from FIG. 8. In the course of this pivoting, the front mounting element 4, in a manner as specified above, is likewise pushed onto the longitudinally extending region of the bar 3 in the same way as onto the front, bent end 3*a* of the same bar 3. Self-locking then takes place, as was described above.

In the case of a required disassembly, the catch lug 42 is, to start with, pivoted away and downwards from the plane of the bar 3. Then, first, the guide rail 1 is pulled off the bar 3 in a horizontal pivoting movement, resulting in a position according to FIG. 8. The, second, the guide rail 1 can be removed completely from the bar 3 by pulling in the pull-out direction, and then taken away, for example, for cleaning purposes.

The mounting elements 4 and 5, may, according to the present disclosure, be formed in one piece and may, according the present disclosure, be made either of metal or of plastic material.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A guide rail configured to be mounted on bars of a grid side part of a household appliance or furniture, the bars running horizontally and bent at an angle in bent end regions, the guide rail comprising:

a quick fastening device including two mounting elements, each mounting element being attached in an end region of the guide rail and configured to be detachably fixed to the bars of the grid side part;

a first mounting section of a first of the mounting elements partially enclosing one of the bars in a longitudinally extending region of the bar;

a second mounting section of the first of the mounting elements partially enclosing the bar at one of the bent end regions of the bar;

wherein one of the bent end regions is a rear bent end region and one of the mounting sections of the first of the mounting elements faces the rear bent end region and is open in a direction towards a rear of the guide rail such that the guide rail is configured to be slid onto and attached to the bar starting from a front of the grid side part;

wherein the first of the mounting elements includes a first leg configured to be located below the bar in a section of the first of the mounting elements such that the first mounting section of the first of the mounting elements partially encloses the bar in its longitudinally extending region, and a resilient catch lug extends upward from the first leg and engages behind the bar that is enclosed by the mounting sections in an assembled position of the guide rail; and wherein an upper free end of the catch lug protrudes into an aperture of a second leg of the first of the mounting elements and overlaps a top side of the bar.

2. The guide rail according to claim 1, wherein a side edge of the catch lug facing the bar runs upwards in an inclined manner in a direction of the bar.

3. The guide rail according to claim 1, wherein the catch lug includes a lead-in chamfer at a rear side facing away from the bar.

4. The guide rail according to claim 1, wherein the catch lug is configured to be pivoted down from a plane of the bar by an operating section of the first leg.

5. The guide rail according to claim 1, wherein the second leg includes a bead running parallel to the bar, and in an assembled state of the guide rail, behind the bar and extends in a direction of the first leg.

6. The guide rail according to claim 5, wherein the second leg includes an embossed feature extending in a direction of the first leg, the embossed feature, in an assembled state of the guide rail, gripping behind the bar.

7. The guide rail according to claim 1, wherein the second leg includes a bulge extending in a direction of the bar.

8. The guide rail according to claim 1, wherein a second of the mounting elements, in an assembled state includes a third leg that rests on a surface of a bar, the third leg including a downwardly angled web and a support lug angled away from the web, further wherein the support lug is arranged on a common plane with a fourth leg of the second of the mounting elements.

9. The guide rail according to claim 8, further comprising transition zones located between the third leg, the downwardly angled web and the support lug angled away from the web, and beads are embossed in the transition zones which beads act as bracing and reinforcement.

10. The guide rail according to claim 1, wherein the mounting elements are manufactured in one piece from metal.

11. The guide rail according to claim 1, wherein the mounting elements are produced in once piece from plastic.

12. The guide rail according to claim 1, wherein one of the mounting elements includes a stop that, in an assembled state of the guide rail, grips behind a vertical bar of the grid side part such that the guide rail is fixed in a sliding direction relative to the grid side part.

* * * * *